US009451798B2

(12) United States Patent
Wegner et al.

(10) Patent No.: US 9,451,798 B2
(45) Date of Patent: Sep. 27, 2016

(54) METHOD FOR CONFIGURING PASSIVE-ASSIST WORK GLOVES

(71) Applicant: GM GLOBAL TECHNOLOGY OPERATIONS LLC, Detroit, MI (US)

(72) Inventors: Diana Marie Wegner, Bloomfield Hills, MI (US); Robert Rolland Fox, Rochester Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 211 days.

(21) Appl. No.: 14/291,119

(22) Filed: May 30, 2014

(65) Prior Publication Data

US 2015/0320127 A1 Nov. 12, 2015

Related U.S. Application Data

(63) Continuation of application No. 14/271,671, filed on May 7, 2014.

(51) Int. Cl.
*A41D 19/015* (2006.01)
*A41D 13/08* (2006.01)

(52) U.S. Cl.
CPC ..... *A41D 19/01558* (2013.01); *A41D 13/082* (2013.01); *A41D 19/01523* (2013.01); *A41D 19/01547* (2013.01)

(58) Field of Classification Search
CPC ..... A41D 13/092; A41D 19/00; A41D 19/01547; A41D 19/02; A63B 71/148; A63B 71/146
USPC ..... 2/20, 159, 161.1, 161.2, 161.3, 161.8, 2/163
See application file for complete search history.

(56) References Cited

U.S. PATENT DOCUMENTS 6,154,885 A * 12/2000 Kobayashi ..... A63B 71/146 2/161.2
6,185,747 B1 * 2/2001 Hughes ..... A41D 19/01505 2/161.6
6,618,860 B1 * 9/2003 Sullivan ..... A63B 71/141 2/159

(Continued)

FOREIGN PATENT DOCUMENTS

EP 2564709 12/2013

OTHER PUBLICATIONS

A. Muralidhar et al., "The Development and Evaluation of An Ergonomic Glove", Applied Ergonomics 30 (online), 1999, pp. 555-563.
International Search Report and Written Opinion dated Aug. 26, 2015 for related PCT Patent Application No. PCT/US2015/033208.

*Primary Examiner* — Tejash Patel
(74) *Attorney, Agent, or Firm* — Parks IP Law LLC; Mickki D. Murray, Esq.

(57) ABSTRACT

The present disclosure relates to a method for configuring a passive-assist glove comprising measuring, in a first measuring operation, force associated with receiving an object into a stress zone at a palmar surface of the hand, the stress zone; measuring, in a second measuring operation, force associated with receiving an object into a dexterity zone at a palmar surface of the hand, the dexterity zone; providing a plurality of palm sections for the glove; and arranging the plurality of palm sections being in the glove based on results of the measuring operation and to allow manipulation of the palm and the at least one of the multiple fingers to receive the object during use of the glove.

18 Claims, 4 Drawing Sheets

(56) References Cited

U.S. PATENT DOCUMENTS 6,704,939 B2 * 3/2004 Faulconer ..... A41D 19/01564 2/161.1
7,578,006 B2 * 8/2009 Garneau ..... A63B 71/14 2/159
7,882,571 B2 * 2/2011 Robba ..... A63B 71/146 2/161.1
8,065,750 B2 * 11/2011 Dassler ..... A41D 19/01523 2/161.1
8,453,266 B2 * 6/2013 Bevier ..... A41D 19/01547 2/161.1
2002/0129436 A1 9/2002 Terris et al.

* cited by examiner

METHOD FOR CONFIGURING PASSIVE-ASSIST WORK GLOVES

TECHNICAL FIELD

The present technology relates to designing work gloves. More specifically, the technology relates to configuring work gloves with passive-assist capabilities.

BACKGROUND

A person performing continual repetitious motions and localized pressure can lead to musculoskeletal disorders (MSD) such as carpal tunnel and tendonitis. MSDs can be associated with symptoms such as discomfort, pain, numbness, and loss of dexterity, among others. Risk factors associated with MSDs include, among others, repetitive motion, repeated impact, high hand force, and high hand-arm vibration.

High hand force is developed when a person's hands or fingers hold or squeeze an object that requires an effort. High hand force can strain muscles as well as tendons in hands and arms. High hand force directly correlates to the manner in which an object is gripped, e.g., a pinch grip with finger versus a power grip with the entire hand.

Gloves have been used as a means of hand protection to reduce the risk of MSD when conducting manual activities. However, poorly fitted gloves can decrease grip strength, putting a person at higher risk for MSD. Poorly fitted gloves can also inhibit hand and finger dexterity—e.g., reducing blood circulation if gloves are too small for the user's hand.

To help reduce the risk of MSDs, work gloves are used to protect the hand and increase friction, resistance, and/or impact between a hand and an object during coupling, referred to as hand-object coupling.

Some conventional technologies include gloves made of lightweight or thin materials, promoting use in a wide range of tasks. Lightweight materials, however, typically do not increase friction or provide protection against impact during hand-object coupling.

Some conventional gloves reduce impact during hand-object coupling. For example, work gloves may include a foam layer to generally distribute and dissipate impact felt on the hand during coupling. Although the foam layer reduces hand force impact, the layer also adds bulk to the glove, sacrificing dexterity.

Yet other gloves promote increased friction during hand-object coupling. As an example, work gloves textured with or coated by a thin layer petroleum based materials (e.g., nitrile). Coated work gloves provide light, flexible and abrasion-resistant option. However, the coating often reduces dexterity due to the stiffness of the materials used within the coating when in contact with objects during coupling.

Existing technologies fail to show a glove having the ability to increase friction as well as maintain dexterity of a user's hand during hand-object coupling.

SUMMARY

Given the aforementioned deficiencies, a need exists for a configurable work glove with passive-assist capabilities. The glove would decrease a user's grip effort while increasing his/her grip force for the same activity.

The work glove can be used by a person or a machine, such as an automated apparatus, e.g., robotic or robotic equipment. A hand of a person and/or a hand of a machine can be used in designing and testing the gloves.

The present disclosure relates to a method for designing a passive-assist glove to be worn on a hand comprising (1) measuring, in a measuring operation, force associated with receiving an object into a stress zone at a palmar surface of the hand, the stress zone comprising a thenar zone, a hypothenar zone, and an interdigital zone, (2) providing a plurality of palm sections for the glove, and (3) arranging the plurality of palm sections being in the glove based on results of the measuring operation and to allow manipulation of the palm to receive the object during use of the glove.

In some embodiments, at least one of the plurality of palm sections corresponds to the thenar zone, the hypothenar zone, and/or the interdigital zone.

Also, the present disclosure relates to a method for designing a passive-assist glove, to be worn on a hand, comprising (1) measuring, in a measuring operation, force associated with receiving an object into a dexterity zone at a palmar surface of the hand, the dexterity zone comprising a thumb and multiple fingers of the hand, (2) providing a plurality of dexterity sections for the glove, and (3) arranging the plurality of dexterity sections being in the glove based on results of the measuring operation and to allow manipulation of at least one of the multiple fingers to receive the object during use of the glove.

In some embodiments, the measuring operation furthering comprising, measuring force associated with receiving the object on a first front zone located on the palmar surface of the hand, on a proximal phalanx of the thumb and at least one of the multiple fingers.

Some embodiments further comprise arranging a dexterity section in the glove, based on results of measuring the force at the first front zone, to cover the first front zone, and to allow manipulation of the thumb and at least one of the multiple fingers to receive the object during use of the glove.

In some embodiments, the measuring operation furthering comprising, measuring force associated with receiving the object on a second front zone located on the palmar surface of the hand, on a middle phalanx of at least one of the multiple fingers.

Some embodiments further comprise arranging a dexterity section in the glove, based on results of measuring the force at the second front zone, to cover the second front zone, and to allow manipulation of at least one of the multiple fingers to receive the object during use of the glove.

In some embodiments, the measuring operation furthering comprising, measuring force associated with receiving the object on a third front zone located on the palmar surface of the hand, on a distal phalanx of the thumb and each of the multiple fingers.

Some embodiments further comprise arranging a dexterity section in the glove, based on results of measuring the force at the third front zone, to cover the third front zone, and to allow manipulation of the thumb and at least one of the multiple fingers to receive the object during use of the glove.

In some embodiments, the measuring operation furthering comprising, measuring force associated with receiving the object on a finger top zone located on the palmar surface of the hand approximately between a distal phalanx and a nail bed of the thumb and each of the multiple fingers.

Some embodiments further comprise arranging a dexterity section in the glove, based on results of measuring the force at the top finger zone, to cover the top finger zone, and to allow manipulation of the thumb and at least one of the multiple fingers to apply pressure to the object during use of the glove.

In some embodiments, the measuring operation furthering comprising, measuring force associated with receiving the object on a first finger side zone located on the palmar surface of the hand approximately between a proximal phalanx and a dorsal surface of the thumb and at least one of the multiple fingers.

Some embodiments further comprise arranging a dexterity section in the glove, based on results of measuring the force at the first finger side zone, to cover the first finger side zone, and to allow manipulation of the thumb and at least one of the multiple fingers to apply pressure to the object during use of the glove.

In some embodiments, the measuring operation furthering comprising, measuring force associated with receiving the object on a second finger side zone located on the palmar surface of the hand approximately between a middle phalanx and a dorsal surface of at least one of the multiple fingers.

Some embodiments further comprise arranging a dexterity section in the glove, based on results of measuring the force at the second finger side zone, to cover the second finger side zone, and to allow manipulation of at least one of the multiple fingers to apply pressure to the object during use of the glove.

In some embodiments, the measuring operation furthering comprising, measuring force associated with receiving the object on a third finger side zone located on the palmar surface of the hand approximately between a distal phalanx and a dorsal surface of the thumb and at least one of the multiple fingers.

Some embodiments further comprise arranging a dexterity section in the glove, based on results of measuring the force at the third finger side zone, to cover the third finger side zone, and to allow manipulation of the thumb and at least one of the multiple fingers to apply pressure to the object during use of the glove.

Other aspects of the present technology will be in part apparent and in part pointed out hereinafter.

DETAILED DESCRIPTION

As required, detailed embodiments of the present disclosure are disclosed herein. The disclosed embodiments are merely examples that may be embodied in various and alternative forms, and combinations thereof. As used herein, for example, exemplary, illustrative, and similar terms, refer expansively to embodiments that serve as an illustration, specimen, model or pattern.

Descriptions are to be considered broadly, within the spirit of the description. For example, references to connections between any two parts herein are intended to encompass the two parts being connected directly or indirectly to each other. As another example, a single component described herein, such as in connection with one or more functions, is to be interpreted to cover embodiments in which more than one component is used instead to perform the function(s). And vice versa—i.e., descriptions of multiple components herein in connection with one or more functions are to be interpreted to cover embodiments in which a single component performs the function(s).

In some instances, well-known components, systems, materials or methods have not been described in detail in order to avoid obscuring the present disclosure. Specific structural and functional details disclosed herein are therefore not to be interpreted as limiting, but merely as a basis for the claims and as a representative basis for teaching one skilled in the art to employ the present disclosure.

I. HAND MAPPING ZONES-FIG. 1

Figure 1:
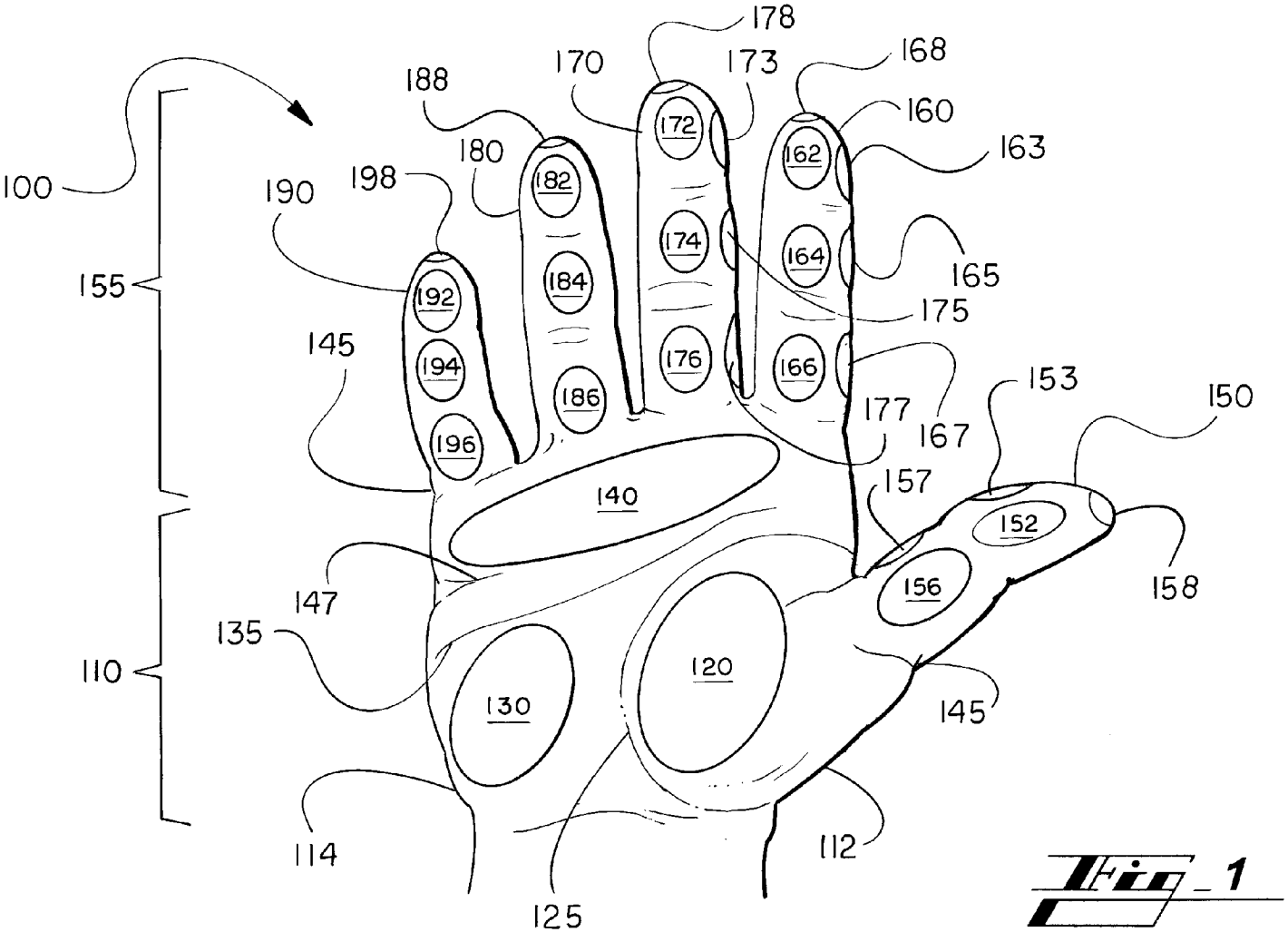
FIG. 1 is a perspective view of a palmar surface of a hand including mapping zones in accordance with an exemplary embodiment.

Turning now to the figures and more specifically the first figure, FIG. 1 is a perspective view of a palmar portion of a hand containing a plurality of mapping zones 100 in accordance with an exemplary embodiment of the present technology.

Hand mapping allows better use of a user's hand during activities with high finger force and/or high hand force. Specifically, hand mapping is a tool in the present technology that allows a designer to create a passive-assist glove 200 (discussed further below in association with FIG. 2) that: (i) increases friction during hand-object coupling, (ii) creates a bearing surface to reduce mechanical stress concentrations, and (iii) utilizes stronger parts of the hand for the force exertions.

First, the mapping allows a designer to create a passive-assist glove to include an appropriate surface on which to increase friction during hand-object coupling. Increasing friction during hand-object coupling reduces the amount of force that is required by the fingers to accomplish a task, such as gripping an object or turning a cap. Increased friction may be of particular interest when the task requires a user to overcome the force of friction to change the position/location of the object—e.g., twisting a lid off of a container. Additionally, increasing friction during hand-object coupling can reduce the force on muscles and tendons, thus reducing the risk of MSDs.

Also, the mapping allows the designer to create, on a passive-assist glove, a bearing surface to reduce mechanical stress concentrations associated with hand-object coupling. Using fingers to pick up an object creates a stress concentration within the engaged fingers, and more specifically, the finger tips. Distributing points of stress to a larger surface area (e.g., the user's entire hand), reduces the stress concentrations, also reducing the risk of MSDs.

Finally, the mapping allows the designer to create a glove that promotes use of the parts of the hand that are strongest for force exertions, which is facilitated through improved hand-object coupling. Grip strength can be measured as (1) power grip—i.e., wrapping the fingers and thumb around an object and squeezing the object to the palm, (2) pinch grip—i.e., grasping an object with only the fingers and thumb, or (3) support grip—i.e., holding an object for an extended period of time with the fingers and thumb. In many individuals, his/her pinch grip is substantially lower than his/her corresponding power grip to the same object. For example, an individual may have a power grip that is 4 to 10 times that of his/her power grip. Thus, using a power grip over a pinch grip promotes efficient use of a person's grip strength.

The zones 100 including mapping within a stress zone 110, located on a palm of the hand, and a dexterity zone 155, including zones on a thumb 150, index finger 160, middle finger 170, ring finger 180, and small finger 190.

Figure 2:
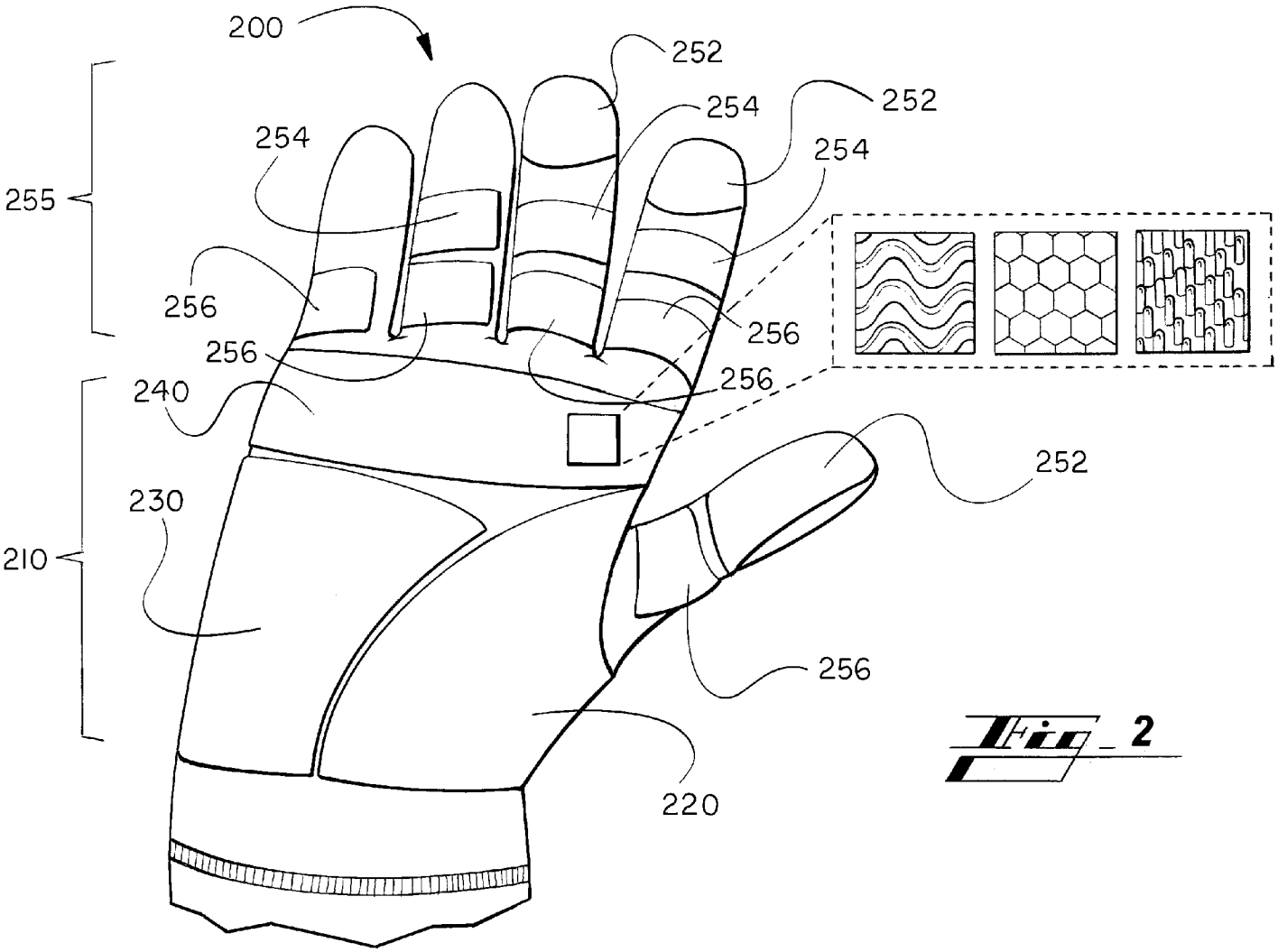
FIG. 2 is a perspective view of a configurable passive-assist glove 200 containing mapping sections corresponding to the mapping zones of FIG. 1.

A hand of a person and/or a hand of a machine can be used in designing and testing a configurable passive-assist work glove 200, described in association with FIG. 2. Force measurements performed within the stress zone 110 and the dexterity zone 155, can, for instance, be performed in connection with an object being placed into or contacted by a palm area of a human hand and/or separately into or contacted by a palm of a machine hand, whether the glove will be eventually used by people or machine.

The stress zone 110 includes areas within the palm that typically receive impact and/or other contact during activities. The stress zone 110 includes a thenar zone 120, a hypothenar zone 130, and an interdigital zone 140.

The thenar zone 120 is an area located near the base of the thumb 150 and is defined by anatomical features on the hand including a radial border 112, a thenar 125, and a palmar digital 145 of the thumb 150. The thenar zone 120 includes a group of muscles known as thenar eminence, which, if damaged, may in turn damage the metacarpophalangeal (MCP) joint of the thumb 150.

The hypothenar zone 130 includes a group of muscles known as hypothenar eminence that controls the motion of the small finger 190. The hypothenar zone 130 is defined by anatomical features including an ulnar border 114, the thenar 125, and a proximal palmar 135. Impact to the hypothenar zone 130 may lead to hypothenar hammer syndrome, which occurs when a person uses the palm of the hand repeatedly, especially the hypothenar eminence, such as in using a hammer to grind, push, and twist objects. These types of activities (e.g., hammering) can damage blood vessels of the hand, resulting in a reduction of blood flow to the fingers.

The interdigital zone 140 is an area located on the middle and upper palm of the hand. The interdigital zone 140 is defined by anatomical features including the distal palmar 147 and a palmar digital 145 of each of the fingers 160, 170, 180, and 190. In some embodiments, the interdigital zone 140 extends down to the proximal palmar 135. The interdigital zone 140 includes a group of ligament fibers known as the transverse fasciculi, which if injured may limit or prevent dexterity with one or more of the fingers 160, 170, 180, and 190.

The dexterity zone 150 includes areas that typically manipulated to grip, insert, or otherwise move objects, specifically the fingers. The dexterity zone 155 includes a plurality of dexterity zones for the thumb 150, the index finger 160, the middle 170, the ring finger 180, and the small finger 190. The plurality of dexterity zones are located on the pulp of the finger (or finger pulp), which is the tissue on the palmar surface for the thumb 150 and each of the fingers 160, 170, 180, and 190.

The plurality of dexterity zones within the thumb 150 include a front zone 152, located on the finger pulp covering a distal phalanx of the thumb 150, and a side zone 153, located near the index finger 160 on the finger pulp covering the distal phalanx. The thumb 150 also includes a front zone 156, located on the finger pulp covering a proximal phalanx of the thumb 150, and a side zone 157, located near the index finger 160 on the finger pulp covering the proximal phalanx. Finally, the thumb 150 includes a top zone 158, located on the tip of the finger pulp, nearest a nail bed of the thumb 150.

The plurality of dexterity zones within the index finger 160 includes zones a front zone 162 and a side zone 163, located on finger pulp covering a distal phalanx of the index finger 160. The front zone 162 is located on a front surface of the finger pulp whereas the side zone 163 is located on a side surface of the finger pulp, closest to the thumb 150. Also, the index finger 160 includes a front zone 164 and a side zone 165, located respectively, on the front surface of the finger pulp and the side surface of the finger pulp of a proximal phalanx of the index finger 160, closest to the thumb 150. Additionally, the index finger 160 includes a front zone 166 and a side zone 167, respectively located on the front surface of the finger pulp and the side surface of the finger pulp of the proximal phalanx of the index finger 160, closest to the thumb 150. Finally, the index finger 160 includes a top zone 168, located on the tip of the finger pulp, nearest a nail bed of the index finger 160.

Similar to the index finger 160, the middle finger 170 includes a plurality of dexterity zones including (ii) a front zone 172 and a side zone 173 on the finger pulp of a distal phalanx of the middle finger 170, (ii) a front zone 174 and a side zone 175, on the finger pulp of a middle phalanx of the middle finger 170, (iii) a front zone 176 and a side zone 177 on the finger pulp of the distal phalanx of the middle finger 170, and (iv) a top zone 178, located on the tip of the finger pulp, nearest a nail bed of the middle finger 170. The front zones 172, 174, 176 are located on the front surface of the finger pulp, whereas the side zones 173, 175, 177 are located on the side surface of the finger pulp, closest to the index finger 160.

The side zones 153, 157 and the top zone 158 of the thumb 150 may be used to move, position, or otherwise arrange small objects (e.g., installing a small electrical connector). The side zones 163, 165, 167 and the top zone 168 of the index finger 160 as well as the side zones 173, 175, 177 and the top zone 178 of the middle finger 170 may also serve a similar functionality.

The ring finger 180 and the small finger 190 each include a plurality of dexterity zones on the finger pulp of (i) a distal phalanx of the respective finger—e.g., front zones 182 and 192, respectively, (ii) the middle phalanx of the respective finger—e.g., front zones 184 and 194, respectively, (iii) the distal phalanx of the respective finger—e.g., front zones 186 and 196, respectively, and (iv) on the tip of the finger pulp, nearest the nail bed of the ring finger 180 and the small finger 190—e.g., top zones 188 and 198, respectively.

The ring finger 180 and the small finger 190 may not include side zones seen in the thumb 150, the index finger 160, and the middle finger 170. Due to hand anatomy, the ring finger 180 and small finger 190 are typically shorter in length than the middle finder 170. As such, the ring finger 180 and index finger 190 may not be used as frequently to arrange objects.

II. PASSIVE-ASSIST GLOVE-FIG. 2

FIG. 2 is a perspective view of the configurable passive-assist glove 200 containing a plurality of sections in accordance with the hand mapping zones 100 of FIG. 1. The glove 200 includes an stress section 210, located on user's palm of the hand, and a dexterity section 150, corresponding to the user's thumb 150, index finger 160, middle finger 170, ring finger 180, and small finger 190.

Each section within the stress section 210 and the dexterity section 250 may be covered by a material that (i) increases friction, (ii) dampens vibration, and/or (iii) resists impact.

The material used for the stress section 210 (referred to as "impact material") may be the same or differing material from the material for the dexterity section 250 (referred to as "dexterity material").

In some embodiments the impact material and/or the dexterity material may include an elastomeric thermoplastic material that includes a high-friction surface developed to enhance grip and reduce slippage between the glove 200 and an object during coupling. The impact and/or material may include textures such as a plurality of gripping surfaces, to effectuate the high-friction surface, as seen in the callout of FIG. 2. An example of such an acceptable high-friction impact and/or dexterity material would be 3M™ Gripping Material (3M is a registered trademark of the 3M Company of Saint Paul, Minn.).

In some embodiments the impact and/or the dexterity material may include an anti-vibration or vibration-dampening material (e.g., polymer such as chloroprene) or other material that includes a surface for reduction of vibrations. The vibration-dampening material may include may include a plurality of gripping surfaces, to effectuate the reduction in vibration. An example of an acceptable vibration-dampening impact and/or dexterity material would be KEVLAR® Vibration-Dampening Material (Kevlar is a registered trademark of E. I. du Pont de Nemours and Company aka/DuPont Company of Wilmington, Del.).

In some embodiments the impact and/or the dexterity material may include an impact resistant material, such as thermoplastic elastomer. The impact resistant material may include may include a plurality of absorption surfaces, to effectuate the reduction in impact. An example of an acceptable impact resistant material would be DUPONT™ HYTREL® (DuPont is a registered trademark of E. I. du Pont de Nemours and Company aka/DuPont Company of Wilmington, Del.).

In some embodiments, the impact material and/or the dexterity material may include force sensing material or other material that measures force associated with hand-object coupling. The force may be measured through any number of conventional methods, such as sensors and the like. The force sensing may include material or components that measures, records, and/or displays the measured force associated with the hand-object coupling. An example of an acceptable force sensing material would be QTC® Material (QTC is a registered trademark of Peratech Limited of the United Kingdom).

In some embodiments, the impact material and/or the dexterity material flex to allow stretching both parallel in direction to manufacturing press (i.e., cross direction) and perpendicular to the direction of manufacturing press (i.e., cross-web direction).

In some embodiments the impact material and/or the dexterity material are attached, after a manufacturing process, to the glove 200 by a bonding material (e.g., adhesive) or other attaching mechanism (e.g., sewn or stich) to the glove 200. In other embodiments, the impact material and/or the dexterity material may be attached directly into the glove 200 during the manufacturing process.

The stress sections 210 includes a thenar section 220, a hypothenar section 230, and an interdigital section 240.

The thenar section 220, located near the base of the user's thumb 150, corresponds to protect the thenar zone 120 of FIG. 1. The thenar section 220 protects the thenar eminence muscles, thus potentially reducing injury to the MCP joint of the thumb 150, among others. Additionally, the thenar section 220 may extend from the palmar surface of the hand (shown in FIG. 1) around the radial border 112 to the dorsal surface of the hand (not shown) to additionally protect the thenar eminence during impact activities (e.g., striking and pounding).

The hypothenar section 230, located near the radial border 114 of the user's hand, corresponds to protect the hypothenar zone 130 of FIG. 1. The hypothenar section 230 protects the hypothenar eminence, thus reducing potential injury to the palm and small finger 190. Additionally, the hypothenar section 230 may extend from the palmar surface of the hand around the ulnar border 114 to the dorsal surface of the hand to additionally protect the hypothenar eminence during impact activities.

The interdigital section 240, located on the middle and upper palm of the hand corresponds to protect the interdigital zone 140 of FIG. 1. Specifically, the interdigital section 240 protects the transverse fasciculi, of the interdigital zone 140, which in turn may protect dexterity associated with the fingers 160, 170, 180, and 190. Additionally, the interdigital section 240 may extend from the palmar surface of the hand to the dorsal surface of the hand approximately below the palmar digital 145 of the index finger 160 and approximately below the palmar digital 145 the small finger 190. The extension of the interdigital section 240 to the dorsal surface may provide additional protection and/or support to the transverse fasciculi during hand-object coupling such as but not limited to gripping.

The dexterity section 250 includes an area to receive one or more user's fingers used to grip and move objects. In some embodiments, the dexterity section 250 may include a compartment to receive the thumb 150 and/or at least one finger 160, 170, 180, 190. In other embodiments, the dexterity section comprises a plurality of compartments, each compartment designed to receive the thumb 150 and/or at least one finger 160, 170, 180, 190.

Any compartments formed within the dexterity section 250 may include a distal phalanx section 252, a middle phalanx section 254, and/or a proximal phalanx section 256. Separating the compartment(s) into sections 252, 254, 256, allows the user to retain natural dexterity (e.g., bending of the fingers at interphalangeal joints) of the hand during hand-object coupling.

The distal phalanx section 252 may be used to cover the distal phalanx zones of the hand. Specifically, the distal phalanx section 252 may protect the front zones 152, 162, 172, 182, 192 of the thumb 150 of the fingers 160, 170, 182, 190 respectively, and/or the side zones 153, 163, 173 of the thumb 150 and the fingers 160, 170, respectively.

In some embodiments comprising the plurality of compartments, the distal phalanx section 252 may be eliminated from a compartment designed to receive the ring finger 180 and/or the small finger 190 (as seen in FIG. 2). Forgoing the distal phalanx section 252 on particular fingers allows manipulation of those fingers for actions such as gripping. Additionally, the ring finger 180 and small finger 190 are not subject to frequent contact and/or impact; therefore removing additional material promotes dexterity within the fingers 180, 190. The plurality of compartments that do not including a distal phalanx section 252 may include another material that protects the surface of the fingers 180, 190 and is flexible in nature (e.g., a thin rubber coating).

Similarly, the middle phalanx section 254 may be used to cover the middle phalanx zones of the hand. Specifically, the middle phalanx section 252 may protect the front zones 164, 174, 184, 194 of the fingers 160, 170, 182, 190 respectively, and/or the side zones 163, 173 of the fingers 160, 170, respectively.

In some embodiments comprising the plurality of compartments, the middle phalanx section 254 may be eliminated from a compartment designed to receive the small finger 190 (as seen in FIG. 2). Forgoing the middle phalanx section 254 on the small finger 190 allows manipulation of the small finger 190 for actions such as gripping. Since the small finger 190 is not subject to frequent contact and/or impact, removing the middle phalanx section 254 material promotes dexterity of the small finger 190. As stated above, the plurality compartments that do not including a middle phalanx section 254 may include another material that protects the surface of the small finger.

The proximal phalanx section 256 may be used to cover the proximal phalanx zones of the hand. Specifically, the proximal phalanx section 256 may protect the front zones 156, 166, 176, 186, 196 of the thumb 150 and the fingers 160, 170, 182, 190 respectively, and/or the side zones 157, 167, 177 of the thumb 150 and the fingers 160, 170, respectively.

In some embodiments, the glove 200 may incorporate additional functional features that improve the user's working capability or monitor of the user and his/her work conditions. For example, the stress section 210 and/or the dexterity section 250 may include additional features such as a light to allow for use of the glove 200 in dimly lit environments. As another example, the stress section 210 and/or the dexterity section 250 may include sensors to monitor the user's work conditions (e.g., measuring a temperature of a contact surface) or the user himself (e.g., monitoring the users blood pressure).

III. IMPACT STUDIES-FIG. 3 THROUGH 6

To show the benefit of the glove 200, experimental data was taken to compare an off-the-shelf (OTS) glove to the configurable passive-assist glove 200. The OTS glove was a rubber dipped glove common to many manufacturing assembly environments. An example of an OTS glove would be an ANSELL® HYFLEX® work glove.

Figure 4:
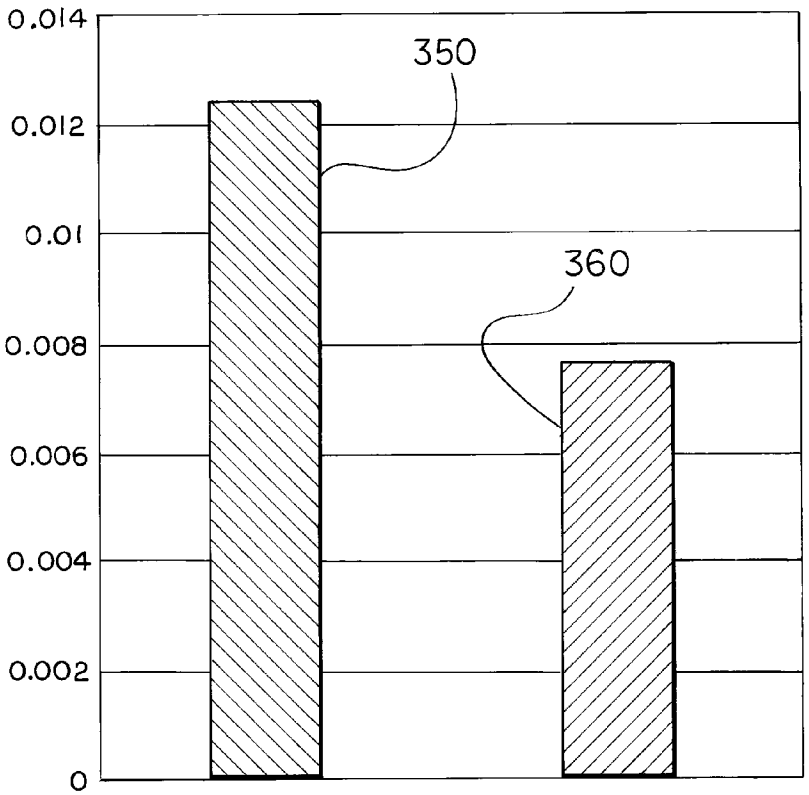
FIG. 4 is a graphical illustration of the maximum effort required using (i) an off-the-shelf work glove and (ii) a configured passive-assist work glove in accordance with an exemplary embodiment for a small object.
Figure 3:
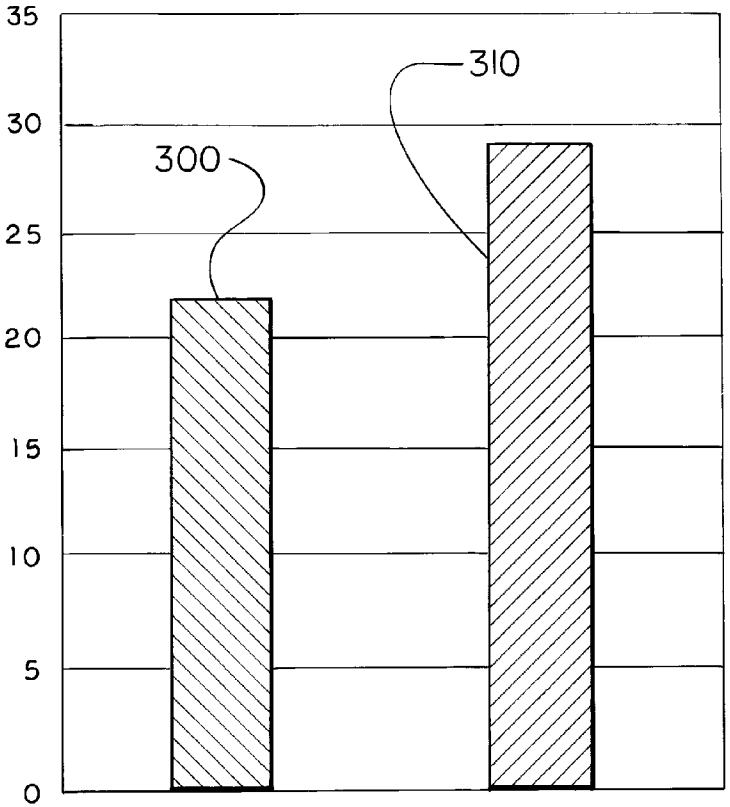
FIG. 3 is a graphical illustration of the maximum force required using (i) an off-the-shelf work glove and (ii) a configured passive-assist work glove in accordance with an exemplary embodiment for a small object.

FIG. 3 illustrate the maximum force applied by a user gripping a small object, such as, but not limited to small electrical connectors, fastener (e.g., screws, nuts, and bolts), or wiring, using (i) the OTS glove (e.g., data block 300) and (ii) the glove 200 (e.g., data block 310). FIG. 4 illustrates the maximum effort applied by the user gripping the same small object using (i) the OTS glove (e.g., data block 350) and (ii) the glove 200 (e.g., data block 360).

Figure 6:
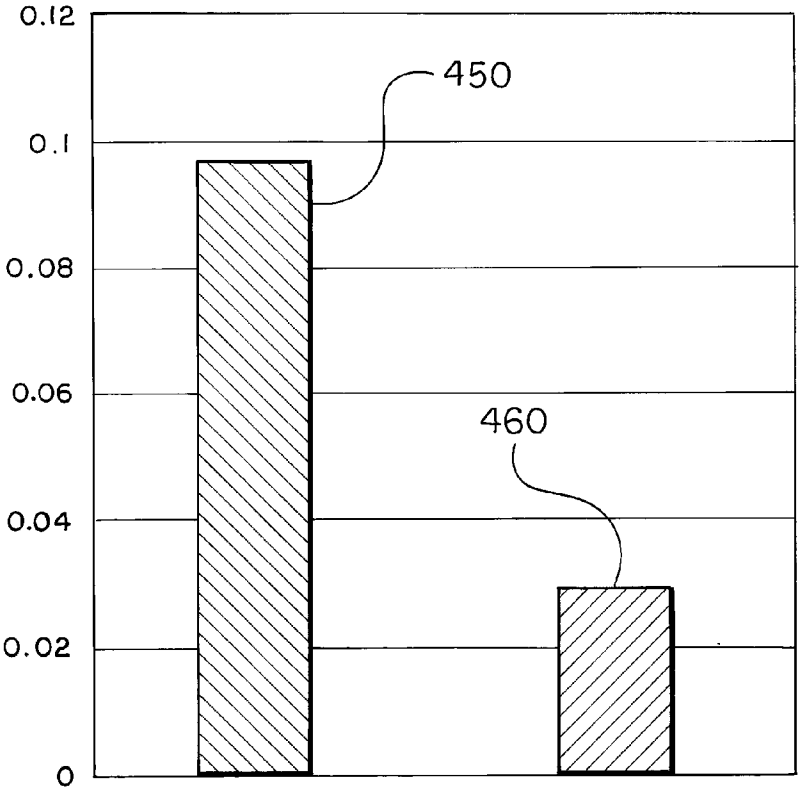
FIG. 6 is a graphical illustration of the maximum effort required using (i) an off-the-shelf work glove and (ii) a configured passive-assist work glove in accordance with an exemplary embodiment for a large object.
Figure 5:
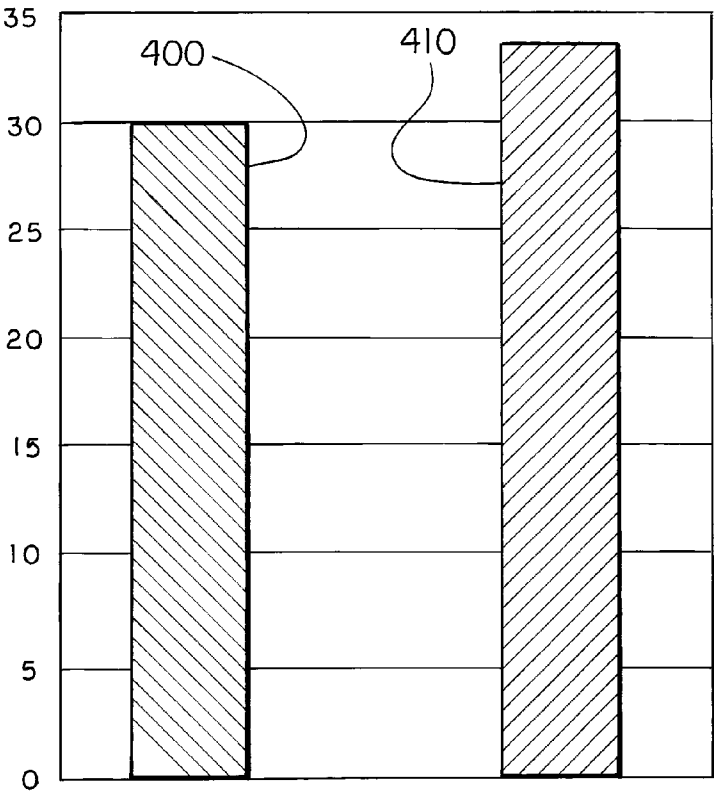
FIG. 5 is a graphical illustration of the maximum force required using (i) an off-the-shelf work glove and (ii) a configured passive-assist work glove in accordance with an exemplary embodiment for a large object.

Similarly, FIG. 5 illustrates the maximum force applied by a user gripping a large object, such as, but not limited to, large electrical connectors, hoses, and sheet metal, using (i) the OTS glove (e.g., data block 400) and (ii) the glove 200 (e.g., data block 410). FIG. 6 illustrates the maximum effort applied by the user gripping the same large object using (i) the OTS glove (e.g., data block 450) and (ii) the glove 200 (e.g., data block 460).

The maximum force is measured in units of pounds the user applies during hand-object coupling. As seen in FIGS. 3 and 5, the glove 200 provided a maximum force that was greater than that of the OTS glove for moving the same object. In fact, the maximum force exerted by the user wearing the glove 200 was more than a 30% increase over the OTS glove for the small object, and more than a 10% increase over the OTS glove for the large object.

The maximum effort is measured through an electromyography (EMG) to capture the electrical potential generated by a set of muscle cells when the muscle cells are electrically or neurologically activated. Units of measurement for the electrical potential is shown in FIGS. 4 and 6 are millivolts (mV).

As seen in FIGS. 4 and 6, the glove 200 provided a maximum effort that was less than the maximum effort required by the OTS glove for the same object. In fact, the maximum effort exerted by the user wearing the glove 200 was almost a 40% decrease over the OTS glove for the small object, and almost a 70% decrease over the OTS glove for the large object.

IV. BENEFITS

Many of the benefits and advantages of the present technology are described herein above. The present section presents in summary some of the benefits of the present technology.

The technology associated with a passive-assist work glove protects a user's hand from sharp edges. Safety is a concern in manufacturing environments where raw materials may have rough or unpolished surfaces. Protecting the user's hand from rough surfaces reduces the risk of injury.

The technology also minimizes impact shock, impact force, and vibration. Repeated shock, force, and vibration can cause injury to a human body, specifically areas such as the hand that can be the point of impact transfer. Reducing the impact and vibration to the hand may reduce the likelihood of long term injuries, such as carpal tunnel.

Additionally, the technology promotes dexterity allowing hand and finger manipulation. Dexterity allows a user to make precisely coordinated movements of the hand(s) to grasp, manipulate, or assemble objects. Also, the technology promotes grip strength, specifically, clasp grip and pinch grip, of the user's hand surfaces. The ability to grip an object with great force can be necessary when moving large objects that are heavy or awkwardly shaped, and the ability to grip an object with minimal force can be required when objects are fragile or easily deformable. Using the same technology to grip objects where either high force (e.g., clasp grip) or low force (e.g., pinch grip) provides the user with the ability to complete a wide range of tasks and activities.

The technology may be used to accomplish tasks where force application is required. The use of force application can be necessary when pressing two objects together or inserting one object into another. Force application also provides the user with the ability to complete a wide range of tasks and activities.

V. CONCLUSION

Various embodiments of the present disclosure are disclosed herein. The disclosed embodiments are merely examples that may be embodied in various and alternative forms, and combinations thereof.

The above-described embodiments are merely exemplary illustrations of implementations set forth for a clear understanding of the principles of the disclosure.

Variations, modifications, and combinations may be made to the above-described embodiments without departing from the scope of the claims. All such variations, modifications, and combinations are included herein by the scope of this disclosure and the following claims.

What is claimed is:

1. A method for designing a passive-assist glove to be worn on a hand comprising:

measuring, in a measuring operation, force associated with receiving an object into a stress zone at a palmar surface of the hand, the stress zone comprising a thenar zone, a hypothenar zone, and an interdigital zone extending from the palmar surface to a dorsal surface of the hand below a palmar digital portion of a small finger;

providing a plurality of palm sections for the glove, each of the plurality of palm sections configured to cover at least a portion of the thenar zone, at least a portion of the hypothenar zone, and at least a portion of the interdigital zone; and arranging the plurality of palm sections being in the glove based on results of the measuring operation and to allow manipulation of the palm to receive the object during use of the glove.

2. The method of claim 1, wherein at least one of the plurality of palm sections corresponds to the thenar zone.

3. The method of claim 1, wherein at least one of the plurality of palm sections corresponds to the hypothenar zone.

4. The method of claim 1, wherein at least one of the plurality of palm sections corresponds to the interdigital zone.

5. A method for designing a passive-assist glove, to be worn on a hand, comprising:

measuring, in a measuring operation, force associated with receiving an object into a dexterity zone at a palmar surface of the hand, the dexterity zone comprising a thumb, an index finger, a middle finger, a ring finger, and a small finger, the thumb having (i) a first side zone located on the palmar surface between a proximal phalanx of the thumb and a dorsal surface of the thumb and (ii) a second side zone located on the palmar surface between a distal phalanx of the thumb and the dorsal surface of the thumb, and each finger having (i) a first side zone located on the palmar surface between a proximal phalanx of the finger and a dorsal surface of the finger and (ii) a second side zone located on the palmar surface between a middle phalanx of the finger and the dorsal surface of the finger;

providing a plurality of dexterity sections for the glove, each of the plurality of dexterity sections configured to cover at least a portion of the first side zone and at least a portion of the second side zone of the index finger and the middle finger; and arranging the plurality of dexterity sections being in the glove based on results of the measuring operation and to allow manipulation of at least one of the fingers to receive the object during use of the glove.

6. The method of claim 5, the measuring operation furthering comprising, measuring force associated with receiving the object on a first front zone located on the palmar surface of the hand, on a proximal phalanx of the thumb and at least one of the fingers.

7. The method of claim 6, further comprising arranging a dexterity section in the glove, based on results of measuring the force at the first front zone, to cover the first front zone, and to allow manipulation of the thumb and at least one of the fingers to receive the object during use of the glove.

8. The method of claim 5, the measuring operation furthering comprising, measuring force associated with receiving the object on a second front zone located on the palmar surface of the hand, on a middle phalanx of at least one of the fingers.

9. The method of claim 8, further comprising arranging a dexterity section in the glove, based on results of measuring the force at the second front zone, to cover the second front zone, and to allow manipulation of at least one of the fingers to receive the object during use of the glove.

10. The method of claim 5, the measuring operation furthering comprising, measuring force associated with receiving the object on a third front zone located on the palmar surface of the hand, on a distal phalanx of the thumb and each of the fingers.

11. The method of claim 10, further comprising arranging a dexterity section in the glove, based on results of measuring the force at the third front zone, to cover the third front zone, and to allow manipulation of the thumb and at least one of the fingers to receive the object during use of the glove.

12. The method of claim 5, the measuring operation furthering comprising, measuring force associated with receiving the object on a finger top zone located on the palmar surface of the hand between a distal phalanx and a nail bed of the thumb and each of the fingers.

13. The method of claim 12, further comprising arranging a dexterity section in the glove, based on results of measuring the force at the finger top zone, to cover the finger top zone, and to allow manipulation of the thumb and at least one of the fingers to apply pressure to the object during use of the glove.

14. The method of claim 5, further comprising arranging a dexterity section in the glove, based on results of measuring the force at the first side zone, to cover the first side zone, and to allow manipulation of the thumb and at least one of the fingers to apply pressure to the object during use of the glove.

15. The method of claim 5, further comprising arranging a dexterity section in the glove, based on results of measuring the force at the second side zone, to cover the second side zone, and to allow manipulation of at least one of the fingers to apply pressure to the object during use of the glove.

16. The method of claim 5, the measuring operation furthering comprising, measuring force associated with receiving the object on a third side zone located on the palmar surface of the hand between a distal phalanx and a dorsal surface of the thumb and at least one of the fingers.

17. The method of claim 16, further comprising arranging a dexterity section in the glove, based on results of measuring the force at the third side zone, to cover the third side zone, and to allow manipulation of the thumb and at least one of the fingers to apply pressure to the object during use of the glove.

18. A method for designing a passive-assist glove to be worn on a hand comprising:

measuring, in a measuring operation, force associated with receiving an object into a dexterity zone at a palmar surface of the hand, the dexterity zone comprising a thumb, an index finger, a middle finger, a ring finger, and a small finger, the thumb having (i) a first side zone located on the palmar surface between a proximal phalanx of the thumb and a dorsal surface of the thumb and (ii) a second side zone located on the palmar surface between a distal phalanx of the thumb and the dorsal surface of the thumb, and each finger having (i) a first side zone located on the palmar surface between a proximal phalanx of the finger and a dorsal surface of the finger and (ii) a second side zone located on the palmar surface between a middle phalanx of the finger and the dorsal surface of the finger;

measuring, in a measuring operation, force associated with receiving an object into a stress zone at the palmar surface, the stress zone comprising a thenar zone, a hypothenar zone, and an interdigital zone extending from the palmar surface to a dorsal surface of the hand below a palmar digital portion of the small finger;

providing a plurality of palm sections for the glove, each of the plurality of dexterity sections configured to cover at least a portion of the first side zone and at least a portion of the second side zone of the index finger and the middle finger and each of the plurality of palm sections configured to cover at least a portion of the thenar zone, at least a portion of the hypothenar zone, and at least a portion of the interdigital zone arranging the plurality of palm sections being in the glove based on results of the measuring operation and to allow manipulation of the palm and the at least one of the fingers to receive the object during use of the glove.

* * * * *